US008085122B2

(12) United States Patent
Niess

(10) Patent No.: US 8,085,122 B2
(45) Date of Patent: Dec. 27, 2011

(54) HIGH VOLTAGE STEP-UP DRY POWER TRANSFORMER AND POWER SUPPLY UNIT COMPRISING AT LEAST ONE SUCH TRANSFORMER

(75) Inventor: Alfred Niess, Hunspach (FR)

(73) Assignee: Bruker Biospin SA, Wissembourg (FR)

( * ) Notice: Subject to any disclaimer, the term of this patent is extended or adjusted under 35 U.S.C. 154(b) by 52 days.

(21) Appl. No.: 12/567,304

(22) Filed: Sep. 25, 2009

(65) Prior Publication Data

US 2010/0085775 A1 Apr. 8, 2010

(30) Foreign Application Priority Data

Sep. 26, 2008 (EP) ..... 08305603

(51) Int. Cl.
*H01F 27/28* (2006.01)
*H01F 27/36* (2006.01)

(52) U.S. Cl. ..... 336/84 M; 336/183; 336/180; 336/84 R

(58) Field of Classification Search ..... 336/84 C, 336/84 M, 84 R, 212, 183, 180
See application file for complete search history.

(56) References Cited

U.S. PATENT DOCUMENTS

| | | | | |
|---|---|---|---|---|
| 3,760,314 | A * | 9/1973 | Krasienko et al. | 336/192 |
| 4,369,353 | A * | 1/1983 | Duenke | 219/492 |
| 4,663,603 | A * | 5/1987 | van Riemsdijk et al. | 336/60 |
| 6,144,564 | A | 11/2000 | Fraidlin | |
| 6,806,803 | B2 * | 10/2004 | Hopkinson et al. | 336/67 |
| 2002/0063487 | A1 | 5/2002 | Leijon | |
| 2006/0226130 | A1 * | 10/2006 | Kooken et al. | 219/130.1 |
| 2008/0001694 | A1 * | 1/2008 | Wang | 336/84 R |
| 2008/0055941 | A1 * | 3/2008 | Victor et al. | 363/17 |

FOREIGN PATENT DOCUMENTS

| | | |
|---|---|---|
| AU | 491001 | 6/1976 |
| GB | 868533 | 5/1961 |
| GB | 1581415 | 12/1980 |
| WO | 9713391 | 4/1997 |
| WO | 9834240 | 8/1998 |
| WO | 9834250 | 8/1998 |
| WO | 9917311 | 4/1999 |

OTHER PUBLICATIONS

Priority European Search Report dated Jul. 9, 2009.

* cited by examiner

*Primary Examiner* — Anh Mai
(74) *Attorney, Agent, or Firm* — Young & Thompson

(57) ABSTRACT

A high voltage step-up power transformer includes at least one module which defines a lower voltage primary side and a higher voltage secondary side and which includes at least one primary winding and at least one secondary winding, wound concentrically around a ferromagnetic core body, the primary winding(s) being situated outwardly, and at least one shielding and/or insulating surface structure being arranged between the primary and secondary windings. The transformer (1) is characterized in that the outer primary winding (2) or winding parts is (are) made of at least one insulated high voltage cable and in that the at least one conductive intermediate surface structure (5) and/or the core body (4) are set at a referential potential which is a fraction of the output voltage or potential difference on the secondary side.

20 Claims, 8 Drawing Sheets

HIGH VOLTAGE STEP-UP DRY POWER TRANSFORMER AND POWER SUPPLY UNIT COMPRISING AT LEAST ONE SUCH TRANSFORMER

The present invention is related to the field of high voltage power supply and concerns more particularly a high voltage step-up dry power transformer, and a power supply unit comprising at least one such transformer.

The typical power range of transformers to be considered in the present invention extends from approximately several kVA to several tens of kVA.

Such transformers provide voltage levels of several thousands to several hundred thousands of V by being connected to the low voltage network (generally at 400 to 600 V).

These transformers have numerous industrial applications, as well as applications in relation to research and analysis equipments and installations.

Such transformers can in particular be part of power supply systems, for example working in switch mode, used to feed high energy devices, such as an IOT (Inductive Output Tube) device connected to its load.

Two main technologies exist in relation to such transformers: the immersed or wet transformers and the dry transformers.

In the first type, the transformer itself is disposed in a housing filled with a liquid dielectric (such as mineral oil) providing electric insulation and cooling of the windings.

These transformers show three major drawbacks: they are bulky and heavy (due to the quantity of liquid and the need of an adapted casing), they constitute an environmental hazard due to the risks of pollution by the dielectric liquid (smoke or cold pollution) and, in case of maintenance or repair operations, the access to the transformer components requests necessarily a complete prior emptying of the dielectric liquid and a complete extraction of all its components from the housing, normally followed by a drying phase.

Therefore, the dry technology has been subject over the last two decades to important developments.

Nevertheless, the electrical insulation of the windings in such transformers (by hot impregnation or coating with thermosetting polymers/by providing separating and encasing insulating hulls between and around the windings) generates important extra costs and also extra weight.

Furthermore, repairing or service operations on such dry transformers are very delicate and/or tedious, due in particular to the insulation layers.

It is a prior purpose of the present invention to overcome at least some of the drawbacks exposed herein before and to provide a dry-type high voltage step-up power transformer which is mainly easy to repair/maintain, not too cumbersome and heavy, and economical to produce.

To achieve these goals, the present invention proposes a high voltage step-up dry power transformer comprising at least one module which defines a lower voltage primary side and a higher voltage secondary side and which comprises at least one primary winding and at least one secondary winding, wound concentrically around a ferromagnetic core body, and at least one shielding and/or insulating surface structure being arranged between the primary and secondary windings, transformer characterized in that the primary winding(s) at a lower voltage is (are) situated outwardly, in that the outer primary winding or winding parts is (are) made of at least one insulated high voltage cable and in that the at least one intermediate conductive surface structure and/or the core body are set at a referential DC potential which is a fraction of the output voltage on the secondary side of the or each module.

Thus, the basic idea of the invention consists in transferring the main electric isolation constraints to the primary side and in making the primary winding of a wire material which is by itself strongly insulated and simultaneously setting the components which are proximate to the secondary winding(s) or disposed between secondary and primary windings at a predetermined potential, so as to limit the need of high level insulation of the secondary winding(s) (by reducing the potential difference level(s) between the secondary winding (s) and its (their) immediate environment) and reducing the risk of damaging its limited insulation. These measures lead to a less cumbersome, less expensive and lighter construction for a dry transformer.

Furthermore, the primary winding forming the outer layer (and as such easy to access) and being the most likely winding to be damaged (as being the most exposed to voltage stress resulting from high potential difference), said winding will concentrate most of the repair/maintenance work.

Finally, the modular construction of the transformer allows to associate several elementary transformer modules in order to build higher voltage/power transformer devices, according to the needs of the given application, the production of each module being easy to standardise. Even for such multiple combined transformer structures (plurality of interconnected modules), the repair/maintenance is easy, as damages or malfunctionings generally affect the outer primary winding(s) and only one module and as each module can be dimensioned so that it can be readily handled preferably by one or at the most two persons.

The invention will be better understood thanks to the following description and drawings of embodiments of said invention given as non limitative examples thereof, wherein.

Figure 1:
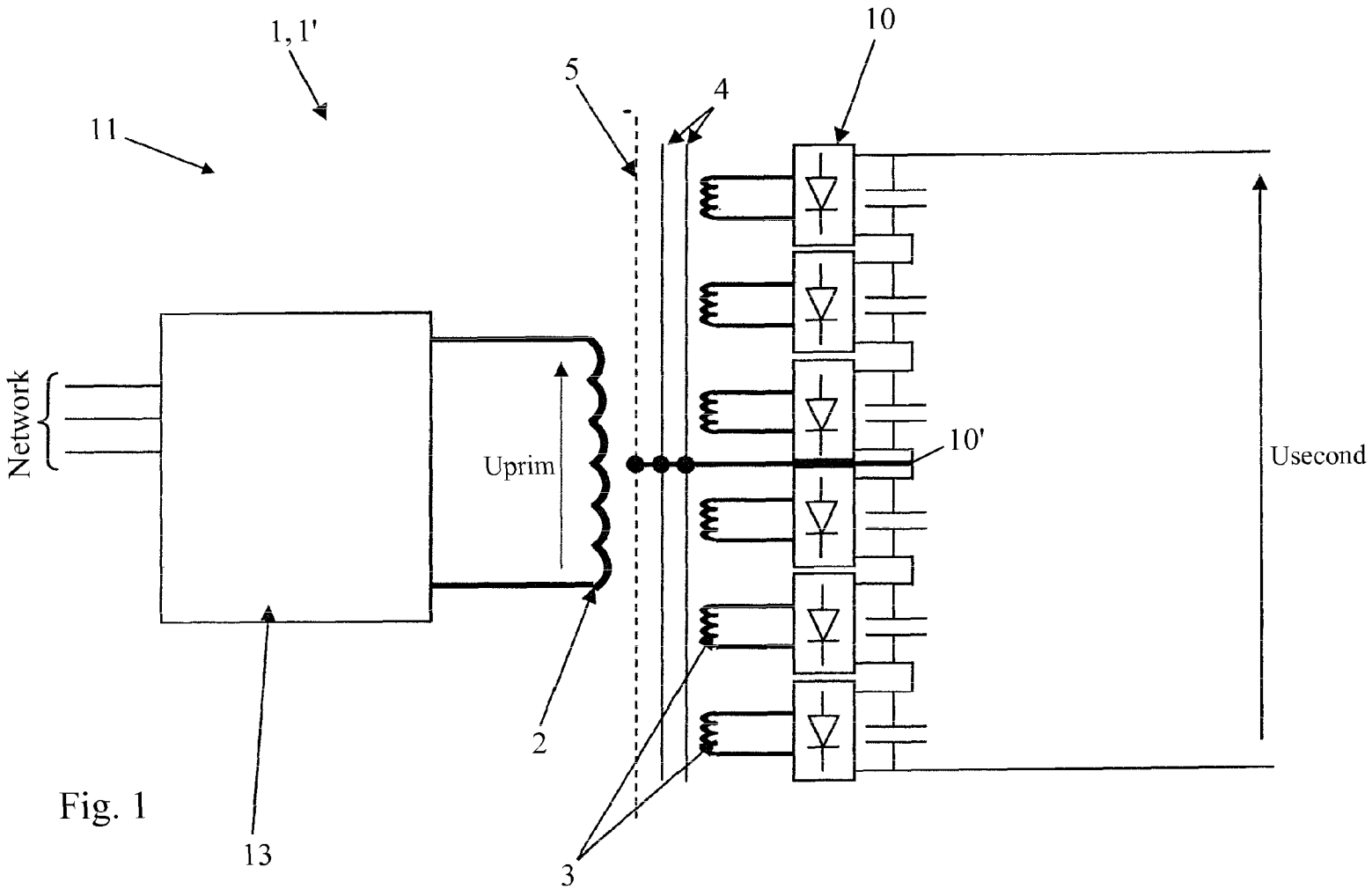
FIG. 1 is a partial schematical representation of a high voltage power supply unit showing a schematical equivalent representation of a transformer according to the invention, comprising one module.

As shown in FIGS. 1 to 7 of the drawings, the high voltage step-up dry power transformer 1 comprises at least one module 1' which defines a lower voltage primary side and a higher voltage secondary side and which comprises at least one primary winding 2 (in one or several parts 2') and at least one secondary winding 3, wound concentrically around a ferromagnetic core body 4, and at least one shielding and/or insulating surface structure 5, 5' being arranged between the primary and secondary windings. It should be noted that the transformer 1 according to the invention can either comprise several modules 1' (usually identical) or be reduced to a single module 1'.

The primary winding(s) 2 is (are) situated outwardly (forming the outer layer(s) of the concentric winding arrangement). According to the invention, the primary winding(s) which is (are) at the lower voltage is (are) situated outwardly, the outer primary winding 2 or winding parts 2' is (are) made of at least one insulated high voltage cable 7 and the at least one intermediate conductive surface structure 5 and/or the core body 4 are set at a referential DC potential which is a fraction of the output voltage on the secondary side of the or each module 1'.

The flexible cable 7, the voltage strength of which is adapted to the voltage output level at the secondary side, can be a high voltage cable with a silicon insulation coating only or with an inner semi conductive layer and an outer silicon insulation coating. Examples of such cables are given in WO-A-98/34240.

Preferably, the at least one conductive surface structure 5 and the core body 4 are set to a DC referential potential which is approximately half of the output voltage on the secondary side, for example by being connected to a potential middle point 10' of the secondary side, advantageously located at or after an associated rectification stage.

Figure 2:
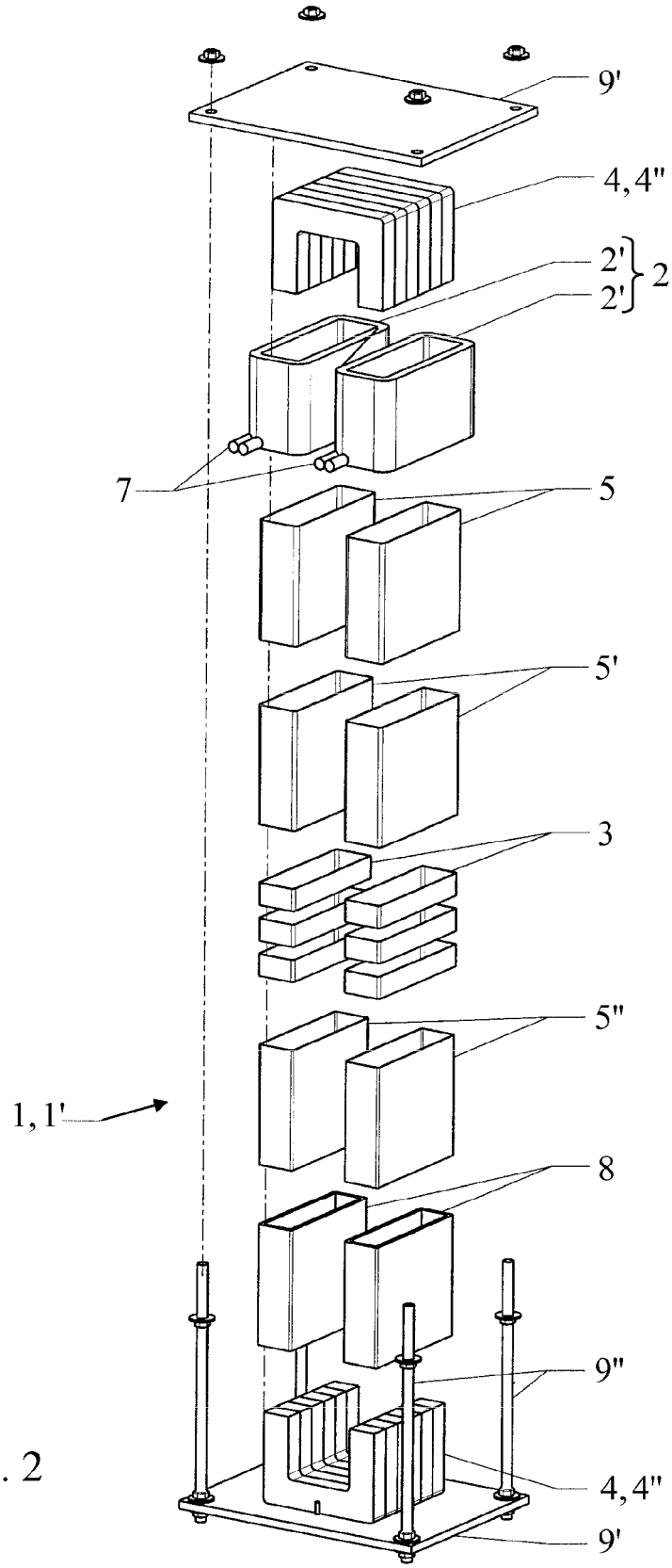
FIG. 2 is an exploded perspective view of a practical embodiment of the transformer module schematically shown in FIG. 1.
Figure 3:
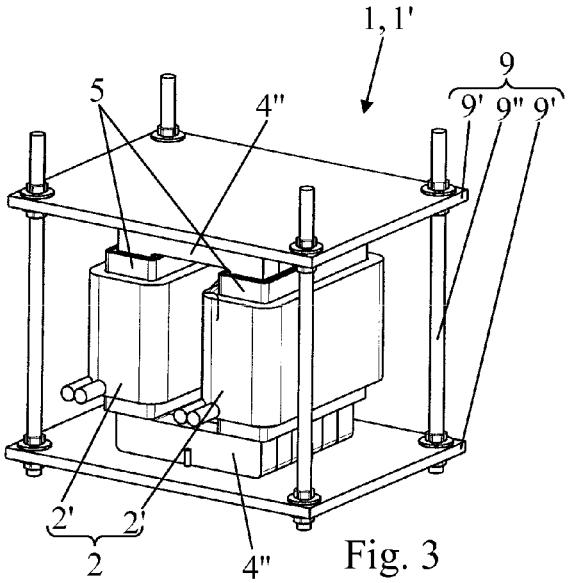
FIG. 3 is a perspective view of the transformer module shown in FIG. 2, in its assembled functional state.
Figure 5:
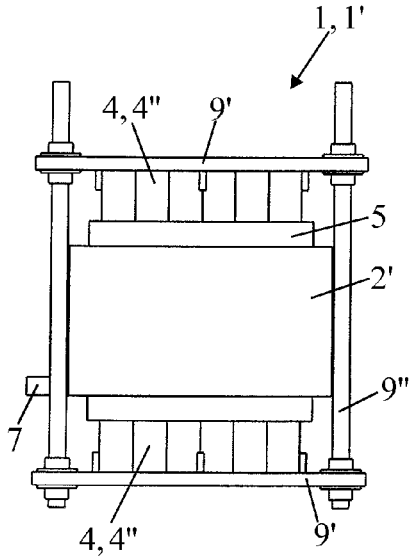
FIGS. 5, 6 and 7 are respectively side, front and bottom (partly transparent view) of the transformer module shown in FIGS. 2 and 3.
Figure 7:
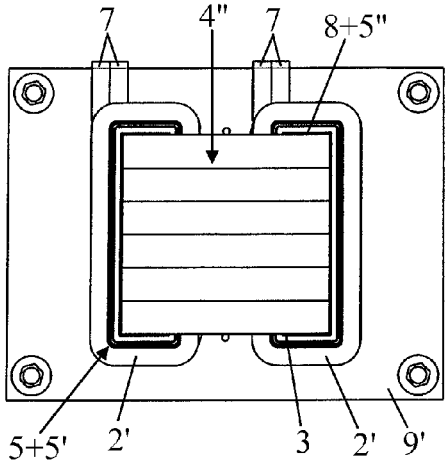
Figure 6:
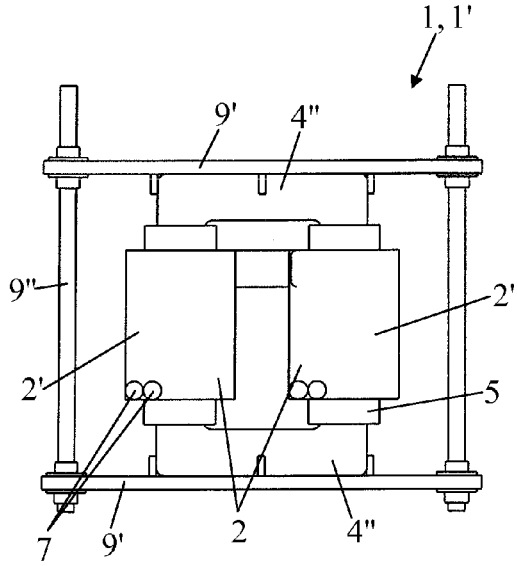
Figure 4:
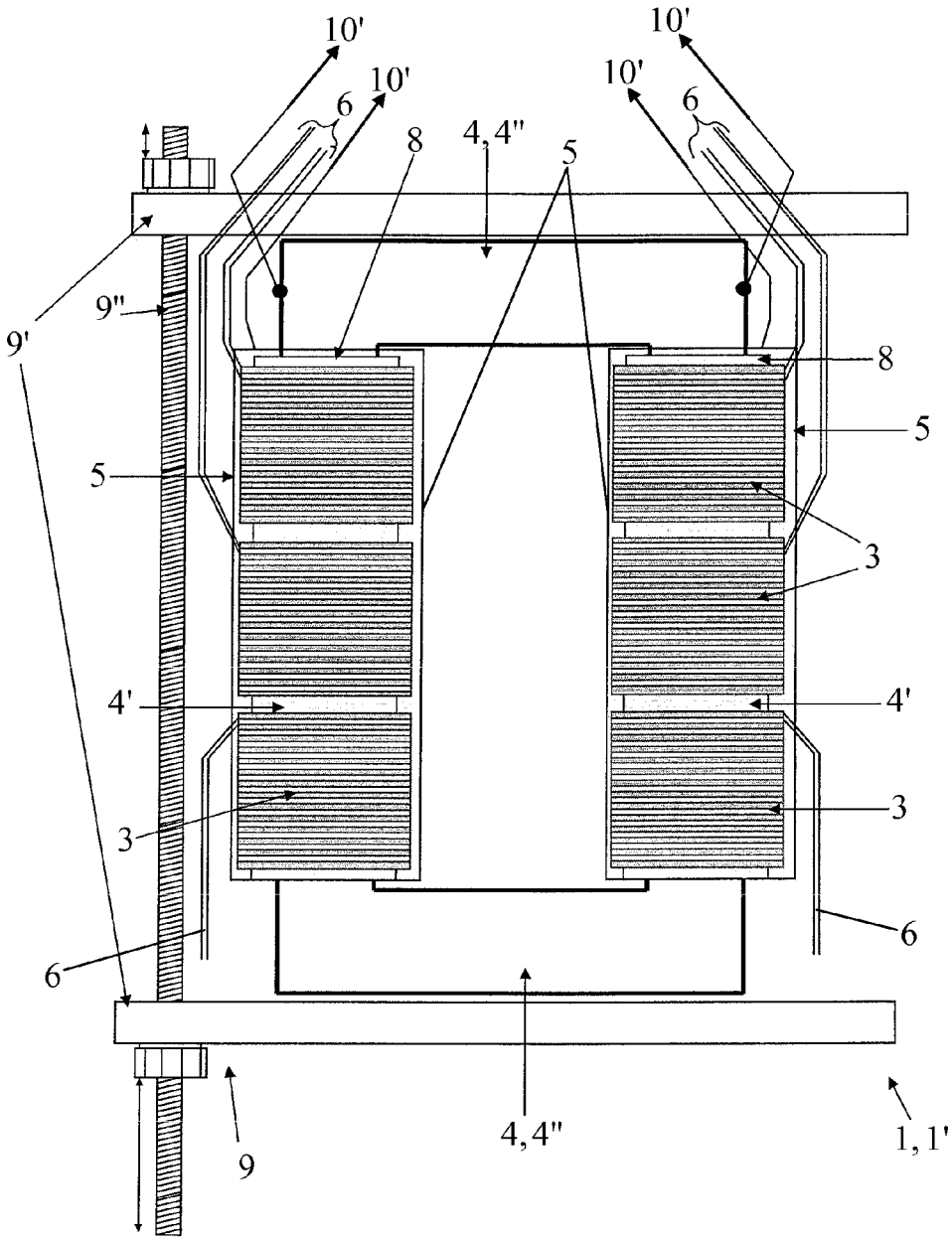
FIG. 4 is a partly transparent schematical side elevation view of the transformer module of FIGS. 2 and 3, not showing the primary winding but showing the secondary output lines.

According to a preferred embodiment of the invention, and as shown in FIGS. 2, 4 and 7 of the drawings, said transformer 1 or each transformer module 1' forming said transformer 1 comprises a double surface structure 5, 5' between the primary 2 and secondary 3 windings and another single surface structure 5" between the secondary winding(s) 3 and the core body 4.

Surface structure 5 can, for example, correspond to a conductive shield structure which is put at a fraction (preferably half) of the output voltage or potential difference of the secondary side, whereas the surface structures 5' and 5" correspond, for example, to insulating screens having a high voltage strength.

In order to facilitate the construction and to ensure an optimal insulation of the secondary windings 3 within the invention, the transformer 1 or each transformer module 1' comprises at least two independent secondary windings 3 having separate pairs of output lines 6, stacked on the same portion of the core body 4 and/or mounted on two or more different portions 4' of said body, the at least one, preferably two, intermediate surface structure(s) 5, 5' covering entirely said secondary windings 3 and having a greater axial extension, along their internal common portion 4' of the core body 4, than the primary winding 2 or winding part 2' arranged outwardly around said secondary windings 3.

The general configuration of the transformer module 1' is given by the shape and the layout of the core body 4, e.g. circular, rectangular, with multiple portions 4' or otherwise shaped.

Around each portion 4' can be arranged one or several independent secondary windings 3, each of them being surrounded by at least a part 2' of the primary winding 2.

The output lines or leads 6 of the secondary windings 3 are of course provided with adapted insulation means and arranged behind shields (shielding against primary voltage strength).

Generally, the primary winding 2 is made from one cable 7.

Nevertheless, when the value of the rated power/current is important it can be contemplated to provide a primary winding 2 made from at least two high voltage cables 7 arranged and wound in parallel (see FIGS. 2, 3, 6 and 7).

Advantageously, the transformer 1 or each module 1' comprises a loop ferrite core body 4 having several identical portions 4', and in that at least one, preferably at least three, independent secondary winding(s) 3 and one part 2' of the primary winding 2 are arranged together concentrically around each of said portions 4' of said core body 4, the secondary windings 3 and the primary winding part 2' arranged around each portion 4' being identical.

As shown on FIGS. 1 and 2, the core body 4 can, for example, have a rectangular shape with two column portions 4', as well as a rectangular transversal section. Said core body 4 can for example be formed by two elementary U-shaped bodies 4" of ferrite material, connected by their free ends of their legs (see FIG. 1).

According to an example of a detailed construction of the transformer 1 according to the invention, the following constitutive components are successively arranged around each portion 4' of the core body 4: a winding support 8; a surface structure forming an insulating screen 5", preferably paper based; at least two stacked, independent and identical secondary windings 3 with separate pairs of output lines 6; a surface structure forming an insulating screen 5', preferably paper based; a surface structure 5 forming a shield, preferably made of a sheet of metal such as copper and provided with a slot; one half 2' of the primary winding 2, the insulation screens 5', 5" (for example made of flexible sheets of Nomex-registered trademark) having a voltage insulation strength higher or greater than half of the nominal output voltage or potential difference on the secondary side and lower than said nominal output voltage or potential difference on the secondary side.

The primary winding 2, for example composed of two identical parts 2' in series in case of two ferrite supporting portions 4' (as on FIGS. 2 to 7), can in relation to a practical non limitative embodiment comprise eight turns and the secondary windings 3 be composed of six identical windings 3 having sixteen turns each, three windings 3 being arranged homogeneously around each of the two portions 4'.

When such an embodiment of the transformer 1 is fed by the 400 V Network through an adequate converter module 13, it can produce on the secondary side an output voltage of around 5 000 V with an average rated power of about 10 to 30 kW at least.

The shield 5 will ensure in a known manner an electrostatic protection around the secondary windings 3. Its opposing ends can possibly be extended so as to form an open shielding casing (with adequately inclined edge portions) and avoid the occurrence of arcs between primary and secondary windings.

As shown on FIGS. 2 to 7, a simple and effective practical construction of each module 1' can be achieved by providing that the components 2, 3, 4, 5, 5', 5", 8 of the or each module 1' are mounted within a laterally open casing 9, for example comprising opposed bottom and top insulating plates 9' rigidly connected together by means of detachable spacers 9", such as threaded rods for example.

When it is necessary to provide a transformer having a rated power which exceeds several times the optimal performance of a module 1' according to the invention, the latter proposes a transformer 1 which comprises an appropriate number of modules 1' arranged and connected in series or in parallel, the output lines 6 of each secondary winding 3 of each module 1' being connected to a rectifier circuit 10.

Said rectifier circuits 10, for example full bridge rectifiers and well-known to the person skilled in the art, can advantageously be mounted on the top plate 9' of each module 1'.

The transformer module(s) 1' and the associated rectifier circuit(s) 10 are installed within an adapted housing (for example a so-called "crate") providing possibly a dust free environment and having forced air circulation for cooling.

The present invention also encompasses, as illustrated on FIGS. 8, 9A, 9B and 10, a high voltage power supply unit 11, for example switch mode power supply adapted to feed an inductive output tube 12 (IOT), comprising at least one [converter module 13/transformer(s) 1] assembly, preferably several such assemblies in parallel, wherein the output of the converter module 13 is connected to the primary winding 2 of at least one transformer 1.

According to the invention, the concerned transformer(s) 1 is a (are) high voltage step-up dry power transformer(s) 1 as described herein before, typically with an average rated power between ten and ninety kW.

Figure 8:
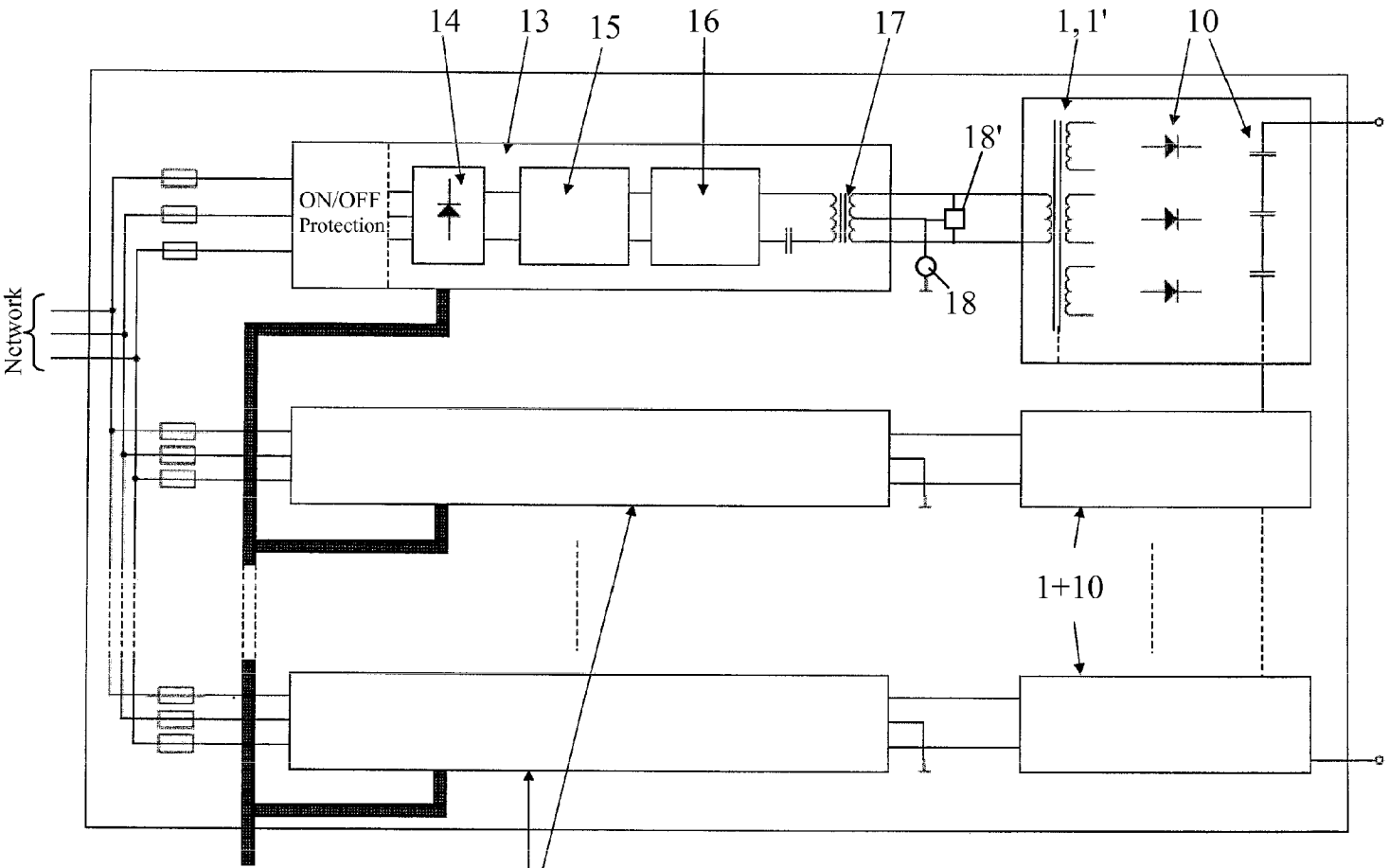
FIG. 8 is a synoptic representation of a high voltage power supply unit according to the invention, incorporating a transformer with several modules according to the invention with their outputs connected in series.

In a preferred embodiment and as shown schematically on FIG. 8, each converter module 13 comprises successively, when considered from its input to its output, a rectifier circuit 14 (AC/DC conversion), a buck converter 15 (energy transfer regulation) and a resonant H-bridge circuit 16 (providing optimal average frequency according to the features of the core body 4), said converter 13 being connected to the primary winding 2 of at least one step-up power transformer 1 through an isolation transformer 17 (isolating the network from the primary winding 2).

This type of converter and its three main components are well-known to the person skilled in the art. Such a converter module 13 is in particular made commercially available by the applicant.

The association [buck converter 15/resonant H-bridge 16] allows to use the same regulation variable (here the voltage) on the primary and the secondary sides. Furthermore, due to resonance properties, the efficiency of the power supply unit is very high (low switching loss of the H-bridge).

In order to ensure a secure operation of the power supply unit 11, this unit can also comprise an insulation default detection means, adapted to detect any insulation default in the primary windings 2 of the transformers 1 and cooperating with automatic shut down means (for example located within the H-bridge circuit 16), as well as an input protection circuit.

The detection means can for example consist in current measuring means 18 sensing the value or level of a grounding current on the primary side of the transformer 1 (or of each of its modules) or of an output current on the secondary side, which currents will be subject to an extremely high and sudden increase in case of an insulation breakdown in the transformer 1 (or in at least one module).

Furthermore, to increase protection, a physical means 18' able to derive automatically the current to the ground in case of insulation breakdown in the transformer 1 can be provided, for example, between the converter module 13 and the primary winding 2 of the transformer 1 or each of its modules 1' (FIG. 8).

When parallel arrangements are considered, the invention allows, depending on the connection configuration between converter modules 13 and transformers 1 or transformer modules 1', to propose supply solutions adapted to the customers request.

Figure 9A:
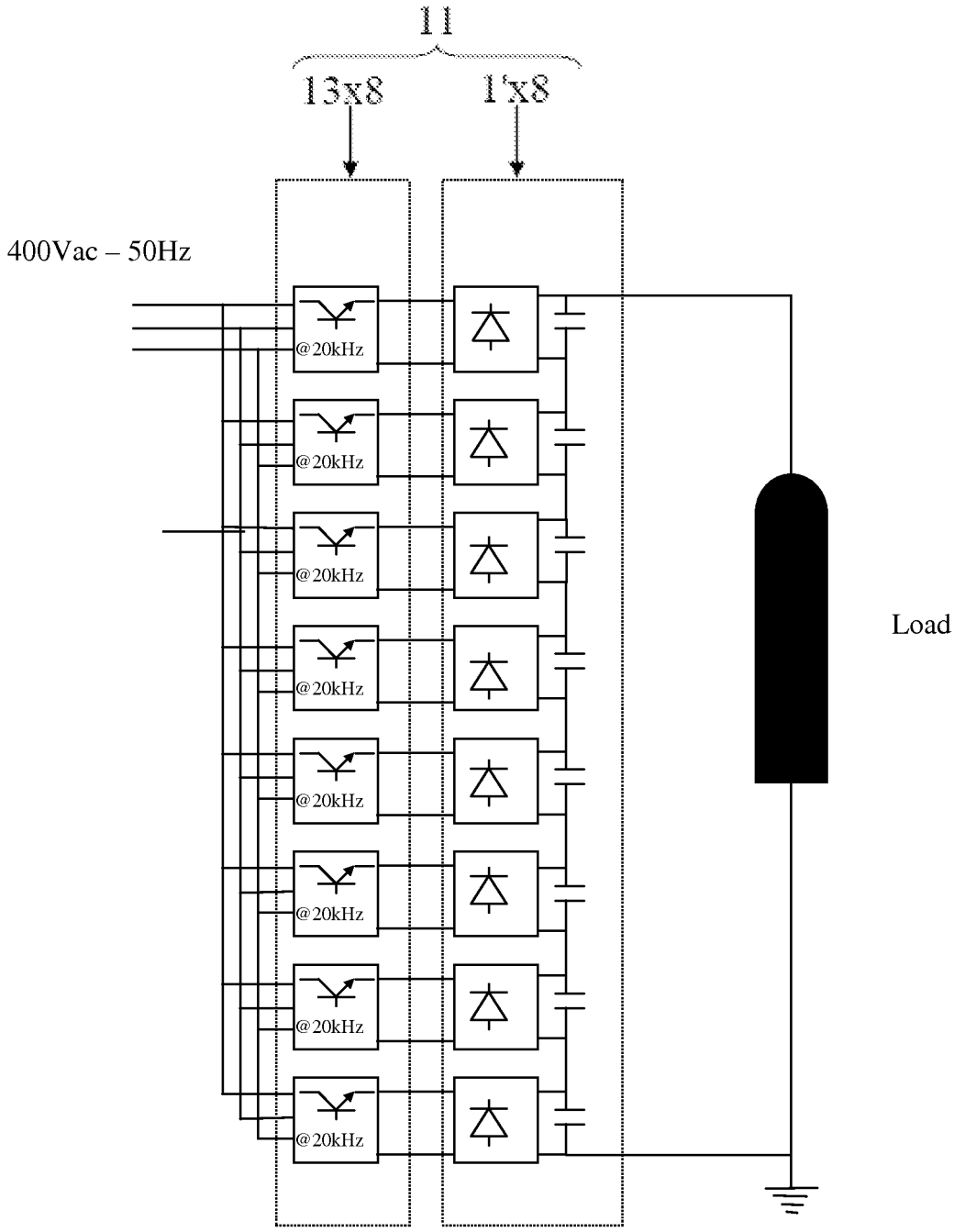
FIGS. 9A and 9B are simplified synoptic representations of high voltage power supply units according to the invention, showing two different configurations of the converter/transformer arrangements, and, FIG. 10 is a simplified synoptic representation of a power supply system for an IOT, incorporating a high voltage power supply unit according to the invention.

Thus, for example to achieve a 160 kW supply, and as shown on FIG. 9A, the power supply unit 11 can comprise several [converter module 13/transformer 1] assemblies arranged and connected in parallel on network side and in series on the secondary output side, each converter module 13 being connected to one transformer 1 or module 1'.

Figure 9B:
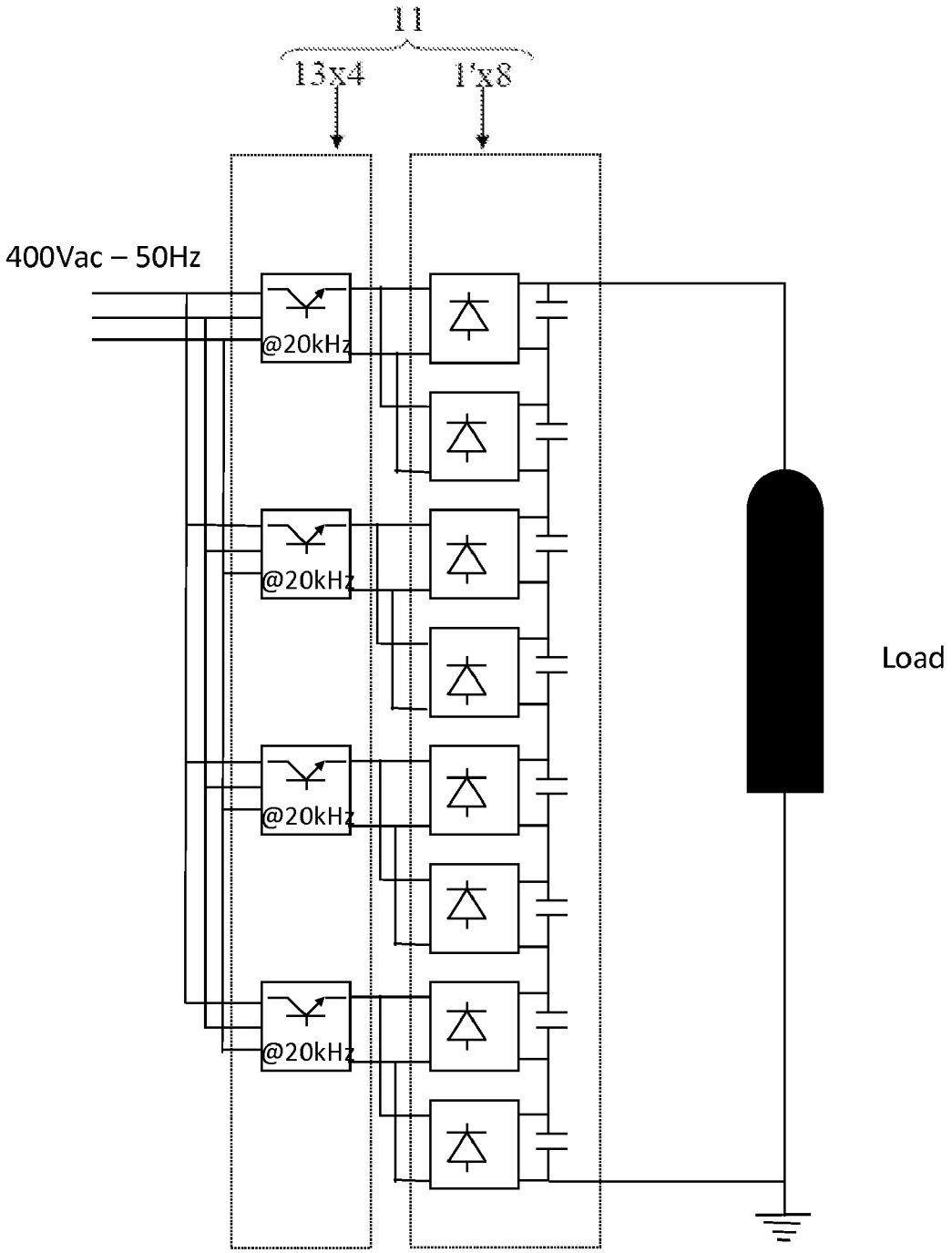

Alternatively, for example to achieve a 80 kW supply (using the same transformer arrangement) and as shown on FIG. 9B, the power supply unit 11 can comprise several [converter module 13/transformers 1] assemblies arranged and connected in parallel on network side and in series on the secondary output side, each converted module 13 being connected to at least two transformers 1 or modules 1'.

Figure 10:
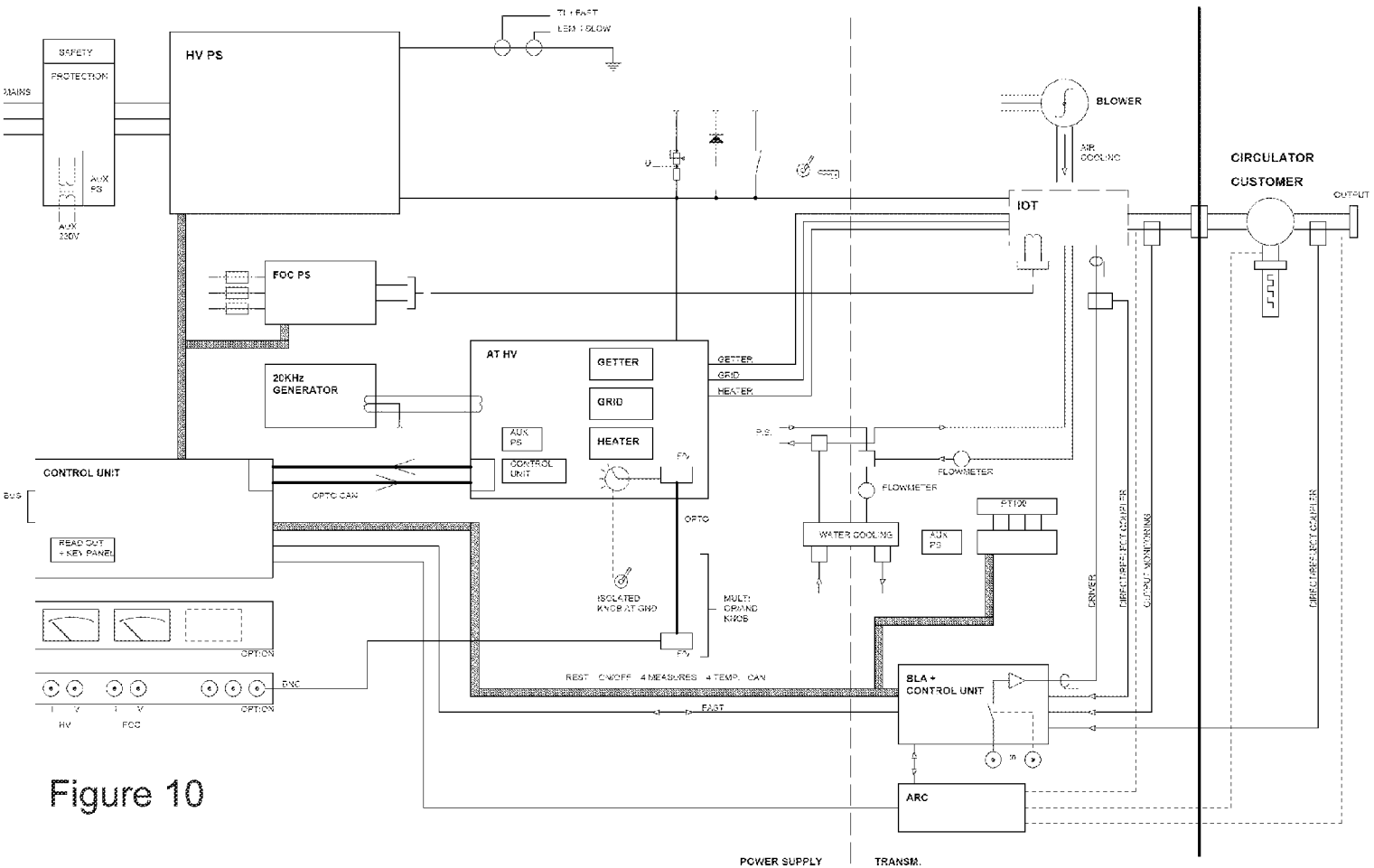

Finally, the present invention also concerns a power supply system for an inductive output tube (IOT) as shown on FIG. 10, incorporating a high voltage power supply unit 11 according to the invention.

The constitution and functioning of such a supply system is known to the person skilled in the art and does not need to be further described herein.

The present invention is, of course, not limited to the preferred embodiments described and represented herein, changes can be made or equivalents used without departing from the scope of the invention.

The invention claimed is:

1. A high voltage step-up dry power transformer comprising:

at least one module which defines a lower voltage primary side and a higher voltage secondary side and which comprises at least one primary winding and at least one secondary winding, wound concentrically around a ferromagnetic core body, and at least one shielding and/or insulating surface structure being arranged between the primary and secondary windings, transformer (1), wherein the primary winding(s) at a lower voltage is situated outwardly, in that the outer primary winding (2) or winding parts (2') is (are) made of at least one insulated high voltage cable (7) and in that the at least one intermediate conductive surface structure (5) and/or the core body (4) are set at a referential DC potential which is a fraction of the output voltage on the secondary side of the or each module (1').

2. The transformer according to claim 1, wherein the at least one surface structure (5) and the core body (4) are set to a referential potential which is approximately half of the output voltage on the secondary side, by being connected to a potential middle point (10') of the secondary side after an associated rectification stage.

3. The transformer according to claim 2, wherein each module (1') comprises a double surface structure (5, 5') between the primary (2) and secondary (3) windings and another single surface structure (5") between the secondary winding(s) (3) and the core body (4).

4. The transformer according to claim 2, wherein each module (1') comprises at least two independent secondary windings (3) having separate pairs of output lines (6), stacked on the same portion of the core body (4) and/or mounted on two or more different portions (4') of said body, the at least one, intermediate surface structure(s) (5, 5') covering entirely said secondary windings (3) and having a greater axial extension, along their internal common portion (4') of the core body (4), than the primary winding (2) or winding part (2') arranged outwardly around said secondary windings (3).

5. The transformer according to claim 1, wherein the primary winding (2) is made from at least two high voltage cables (7) arranged and wound in parallel.

6. The transformer according to claim 1, wherein each module (1') comprises a loop ferrite core body (4) having several identical portions (4'), and in that at least one independent secondary winding(s) (3) and one part (2') of the primary winding (2) are arranged together concentrically around each of said portions (4') of said core body (4), the secondary windings (3) and the primary winding part (2') arranged around each portion (4') being identical.

7. The transformer according to claim 6, wherein, around each portion (4') of the core body (4), the following constitutive components are successively arranged: a winding support (8); a surface structure forming an insulating screen (5");

at least two stacked, independent and identical secondary windings (3) with separate pairs of output lines (6); a surface structure forming an insulating screen (5');

a surface structure (5) forming a shield made of a sheet of metal and provided with a slot;

one half (2') of the primary winding (2), the insulation screens (5', 5") having a voltage insulation strength higher than half of the nominal output voltage or potential difference on the secondary side and lower than said nominal output voltage or potential difference on the secondary side.

8. The transformer according to claim 1, each of components (2, 3, 4, 5, 5', 5", 8) of the or each module (1') are mounted within a laterally open casing (9), comprising opposed bottom and top insulating plates (9') rigidly connected together by means of detachable spacers (9").

9. The transformer according to claim 1, comprises at least two modules (1') arranged and connected in series or in parallel, the output lines (6) of each secondary winding (3) of each module (1') being connected to a rectifier circuit (10).

10. The transformer according to claim 1, wherein each module (1') comprises a double surface structure (5, 5') between the primary (2) and secondary (3) windings and another single surface structure (5") between the secondary winding(s) (3) and the core body (4).

11. The transformer according to claim 1, wherein each module (1') comprises at least two independent secondary windings (3) having separate pairs of output lines (6), stacked on the same portion of the core body (4) and/or mounted on two or more different portions (4') of said body, the at least one intermediate surface structure(s) (5, 5') covering entirely said secondary windings (3) and having a greater axial extension, along their internal common portion (4') of the core body (4), than the primary winding (2) or winding part (2') arranged outwardly around said secondary windings (3).

12. A high voltage power supply unit, comprising:

at least one [converter module/transformer(s)] assembly, comprising:

at least one module which defines a lower voltage primary side and a higher voltage secondary side and which comprises at least one primary winding and at least one secondary winding, wound concentrically around a ferromagnetic core body, and at least one shielding and/or insulating surface structure being arranged between the primary and secondary windings, transformer (1), wherein the primary winding(s) at a lower voltage is situated outwardly, in that the outer primary winding (2) or winding parts (2') is (are) made of at least one insulated high voltage cable (7) and in that the at least one intermediate conductive surface structure (5) and/or the core body (4) are set at a referential DC potential which is a fraction of the output voltage on the secondary side of the or each module (1'), wherein the output of the converter module is connected to the primary winding of at least one transformer, wherein typically with an average rated power between ten and ninety kW.

13. The power supply unit according to claim 12, wherein each converter module (13) comprises successively, when considered from its input to its output, a rectifier circuit (14), a buck converter (15) and a resonant H-bridge circuit (16), said converter (13) being connected to the primary winding (2) of at least one step-up power transformer (1) through an isolation transformer (17).

14. The power supply unit according to claim 13, further comprising an insulation default detection means, adapted to detect any insulation default in the primary windings (2) of the transformers (1) and cooperating with automatic shut down means, as well as an input protection circuit.

15. The power supply unit according to claim 13, further comprising at least two [converter module (13)/transformer (1)] assemblies arranged and connected in parallel on network side and in series on the secondary output side, each converted module (13) being connected to one transformer (1) or module (1').

16. The power supply unit according to claim 13, further comprising at least two [converter module (13)/transformers (1)] assemblies arranged and connected in parallel on network side and in series on the secondary output side, each converted module (13) being connected to at least two transformers (1) or module (1').

17. The power supply unit according to claim 12, comprises several [converter module (13)/transformer (1)] assemblies arranged and connected in parallel on network side and in series on the secondary output side, each converted module (13) being connected to one transformer (1) or module (1').

18. Power supply unit according to claim 12, further comprising several [converter module (13)/transformers (1)] assemblies arranged and connected in parallel on network side and in series on the secondary output side, each converted module (13) being connected to at least two transformers (1) or module (1').

19. The power supply unit according to claim 12, further comprising an insulation default detection means, adapted to detect any insulation default in the primary windings (2) of the transformers (1) and cooperating with automatic shut down means, as well as an input protection circuit.

20. The power supply unit according to claim 19, wherein it comprises at least two [converter module (13)/transformers (1)] assemblies arranged and connected in parallel on network side and in series on the secondary output side, each converted module (13) being connected to at least two transformers (1) or module (1').

* * * * *